US012264484B2

(12) United States Patent
Quesada Barbero et al.

(10) Patent No.: US 12,264,484 B2
(45) Date of Patent: Apr. 1, 2025

(54) DEVICE FOR LEVELLING AND SEPARATING FLOOR TILES

(71) Applicant: GERMANS BOADA, S.A., Rubi (ES)

(72) Inventors: Juan Antonio Quesada Barbero, Rubi (ES); Salvador Duran Conesa, Rubi (ES); María Sanchez Mora, Rubi (ES)

(73) Assignee: GERMANS BOADA, S.A., Rubi (ES)

( * ) Notice: Subject to any disclaimer, the term of this patent is extended or adjusted under 35 U.S.C. 154(b) by 206 days.

(21) Appl. No.: 18/000,273

(22) PCT Filed: Feb. 3, 2021

(86) PCT No.: PCT/ES2021/070082

§ 371 (c)(1),
(2) Date: Nov. 29, 2022

(87) PCT Pub. No.: WO2022/167703

PCT Pub. Date: Aug. 11, 2022

(65) Prior Publication Data

US 2023/0243164 A1 Aug. 3, 2023

(51) Int. Cl.
*E04F 21/00* (2006.01)
*E04F 21/22* (2006.01)

(52) U.S. Cl.
CPC ..... *E04F 21/0092* (2013.01); *E04F 21/22* (2013.01)

(58) Field of Classification Search
CPC ... E04F 21/00; E04F 21/0076; E04F 21/0092; E04F 21/22; E04F 21/20
See application file for complete search history.

(56) References Cited

U.S. PATENT DOCUMENTS

| | | | | |
|---|---|---|---|---|
| 7,992,354 | B2 | 8/2011 | Doda, Jr. | |
| 10,662,707 | B2 * | 5/2020 | Koeman, IV | E06C 7/44 |
| 10,724,254 | B1 * | 7/2020 | Troxell | E04F 21/0092 |
| 10,895,081 | B2 * | 1/2021 | Mendiluza | E04F 21/0092 |
| 10,947,740 | B2 * | 3/2021 | Sighinolfi | E04F 15/02022 |
| 11,078,674 | B2 * | 8/2021 | Troxell | E04F 21/22 |

(Continued)

FOREIGN PATENT DOCUMENTS

| | | |
|---|---|---|
| CA | 2892352 | 11/2016 |
| EP | 3789560 | 3/2021 |

(Continued)

OTHER PUBLICATIONS

WIPO, International Search Report for PCT/ES2021/070082, Sep. 30, 2021.

*Primary Examiner* — Chi Q Nguyen
(74) *Attorney, Agent, or Firm* — Hodgson Russ LLP

(57) ABSTRACT

A device for levelling and separating floor tiles, comprising:—a body with a supporting base (11) for the tiles (B) and a separator element (12) linked to said base (11) by pre-weakened break points (13), and—a levelling wedge (2) suited to be inserted into a window (14) in the separator element (12) and which comprises a lower surface (21) for support on the tiles (B) and an upper surface (22) with a plurality of teeth (26) presenting superiorly, in a transversal direction, a curvature, defining therein:—a higher central area (26*a*) for initial contact with a central part (14*a*) of the upper end of the window in the separator element (12) and—laterally descending areas (26*b*) for progressive contact with lateral parts (14*b*) that are more remote from said central part (14*a*) of the window (14).

4 Claims, 4 Drawing Sheets

(56) References Cited

U.S. PATENT DOCUMENTS

| | | | | |
|---|---|---|---|---|
| 11,242,688 | B2 * | 2/2022 | Bordin | E04F 21/20 |
| 11,408,186 | B1 * | 8/2022 | Bunch | E04F 21/1877 |
| 11,643,826 | B1 * | 5/2023 | Troxell | E04F 21/22 52/126.5 |
| 2015/0308130 | A1 * | 10/2015 | Biec | E04F 21/0092 52/749.11 |
| 2019/0048599 | A1 * | 2/2019 | Papadatos | E04F 21/0092 |
| 2019/0063084 | A1 * | 2/2019 | Bunch | E04F 21/0092 |
| 2019/0383027 | A1 * | 12/2019 | Sighinolfi | E04F 21/22 |
| 2021/0131124 | A1 * | 5/2021 | Bunch | E04F 21/22 |
| 2021/0180339 | A1 | 6/2021 | Prestes de Andrade | |

FOREIGN PATENT DOCUMENTS

| | | |
|---|---|---|
| ES | 2748201 | 3/2020 |
| WO | 2019111150 | 6/2019 |

* cited by examiner

DEVICE FOR LEVELLING AND SEPARATING FLOOR TILES

CROSS-REFERENCE TO RELATED APPLICATION

This application is a U.S. national stage entry of International Application No. PCT/ES2021/070082, filed Feb. 3, 2021, the entire disclosure of which is incorporated herein by reference.

TECHNICAL FIELD

The present invention can be used in the construction sector and more specifically in the laying of floor tiles, or covering parts, on floors, walls or any other surface. More specifically, the object of the invention relates to a device for levelling and uniform separating of floor tiles during laying thereof.

BACKGROUND

Devices used for levelling and aligning floor tiles are currently known, such as the one disclosed for example in U.S. Pat. No. 7,992,354 B2, comprising a body provided with a supporting base and a separator element perpendicular to the base and linked thereto by means of a break line. The separator element divides the supporting base into two halves, suited for supporting on each of them the respective floor tiles to be levelled. Said floor tiles make contact with two edges or ends facing against opposite faces of the separator element, said separator element determining the separation between said floor tiles.

To perform the levelling of the floor tiles placed on the base, the device comprises a wedge that is arranged above said floor tiles and which is inserted into a window defined in the separator element; said wedge acts with a lower surface against the upper surface of the floor tiles and with an upper, serrated surface against the upper end of the window in the separator element.

In devices of this type, existing in the market, the wedges are reusable but have a short lifespan since the pressure exerted by the separator element against the upper surface of the wedge causes the teeth defined in said upper surface to be crushed, suffering a permanent deformation, so that the wedge becomes unusable, requiring replacement.

In this type of wedges, the teeth defined on the upper surface present a uniform height in transversal direction, and are located in planes parallel to the separator element, which causes a low progressivity in the tensioning of the separator element as the wedge is inserted into the front window therein, regardless of whether said insertion of the wedge is performed manually or by using a tightening pincer, as disclosed for example in patent ES 2748201 B2 of the same holder of the present invention.

During the insertion of the wedge into the window in the separator element, the successive teeth make contact frontally and with the entire length thereof against the upper end of the front window in the separator element, requiring a significant force for the teeth to deform and pass to the other side of the window, which causes the permanent deformation and lack of progressiveness in the aforementioned tensioning.

The use of the pincer to cause the advance of the wedge through the window in the separator element often causes the premature breakage of the separator element by the break point near the base, which entails having to remove the ceramic pieces positioned on said base, cleaning the surface, replacing the adhesive cement and placing new levelling devices to repeat the levelling operation, thus preventing the separator element from prematurely breaking again.

This breakage occurs because a progressive pressure is applied manually to the pincer, but the resistance to the advance of the wedge alternately varies in intensity, increasing sharply each time a tooth has to surpass the window, and then decreasing sharply thereafter.

To overcome these points of resistance, the wedges present a rear surface suited for thrusting using a pincer, which lacks the ergonomics required to press the wedge manually, at least during the initial phase of insertion into the window in the separator element, which causes fatigue in the fingers of the installer and possible long-term injuries, taking into account that during a working day hundreds of levelling and separator devices for floor tiles can be placed, and that the wedge presents an appreciably uniform width along the entire length thereof, and adjusted to the width of the front window in the separator element.

SUMMARY

The device for levelling and separating floor tiles object of this invention, being of the type described in the preamble of the first claim, presents the particularity of including a series of technical features, oriented to solve in a satisfactory manner the aforementioned drawbacks and more specifically to:—minimise the resistance variations offered by the wedge during the advance thereof, providing a progressive resistance to the advance, improving the sensitivity during the application of the thrusting force, and reducing the risk of premature breakage of the separator element;—reducing the risk of plasticisation and permanent deformation of the teeth by increasing the service life of the wedge; and—improving the ergonomics of said wedge in order to facilitate the insertion thereof into the window in the separator element and to allow the laying thereof and the levelling of the floor tiles in a comfortable manner by thrusting it manually.

In order to achieve the proposed objectives, the teeth of the wedge present superiorly, in a transversal direction, a curvature, defining therein:—a higher central area forming an area for initial contact of the teeth with a central part of the upper end of the window in the separator element during the frontal insertion of the wedge into the window in the separator element, and—laterally descending areas for progressive contact with lateral parts that are more remote from the central part of the upper end of said window.

The aforementioned curvature of the upper end of the tooth means that first there is contact between the tooth and the central part of the upper end of the window in the separator element, and that the effort for inserting the wedge into the window in the separator element increases progressively as the tooth makes contact with the parts that are more remote from the centre of the window, thus preventing the tooth from having to deform simultaneously along the entire length thereof, solving the aforementioned problems.

This makes the stress distribution between the contact of the separator element and the wedge much more uniform than in wedges with flat teeth. The effect is that the separator element-wedge assembly has a better performance, thus increasing the life of the wedge.

According to the invention, the wedge presents on both sides of the upper surface respective longitudinal recesses delimiting on said upper surface a central longitudinal portion, separated laterally from the lateral surfaces of the wedge and in which the teeth are defined. These longitudinal recesses may be formed by flat or curved chamfers and provide a free space for contact between the sides of the window in the separator element and the upper area of the wedge, providing flexibility and releasing the tension of the separator element in the aforementioned area.

Advantageously, the teeth present chamfered lateral ends, converging towards the upper area, which contributes, as well as the aforementioned features, to improve stress distribution and to prevent plasticisation of the material forming the teeth of the wedge.

As mentioned above, this wedge additionally presents ergonomic features oriented to facilitate its insertion into the window in the separator element and to allow it to be pushed manually in a comfortable manner until the floor tiles are levelled.

For this purpose, the wedge presents a concave recess on the rear surface thereof forming an ergonomic surface suited for manual thrusting of the wedge.

The manual thrusting of the wedge until the floor tiles are levelled is possible due to the lower resistance to the advance of the wedge, and mainly due to the curved geometry of the teeth.

In order to facilitate the initial insertion thereof in a comfortable and fast manner into the window in the separator element, the wedge presents in the front area thereof a segment of decreasing width in lateral direction towards the front end thereof; the width of said front end of the wedge being considerably smaller than the width of the window in the separator element. This segment of decreasing width allows the wedge to be easily inserted into the window with a certain inclination, to one side or the other, with respect to the vertical middle plane in said window.

BRIEF DESCRIPTION OF THE DRAWINGS

As a complement to the description provided herein, and for the purpose of helping to make the features of the invention more readily understandable, the present specification is accompanied by a set of drawings which, by way of illustration and not limitation, represent the following.

DETAILED DESCRIPTION

Figure 1:
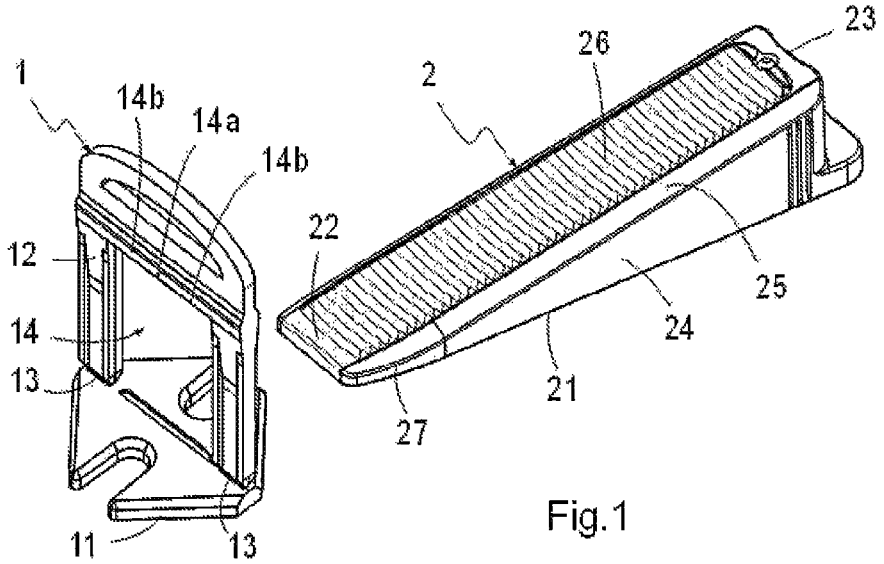
FIG. 1 shows a front perspective view of an exemplary embodiment of the device for levelling and separating floor tiles, according to the invention, in which the body and the wedge have been depicted separated or disassembled.

As can be seen in FIG. 1 the device of the invention comprises a body (1) and a wedge (2).

The body (1), with a general "T" profile, comprises a base (11) and a separator element (12) perpendicular to the base (11), linked thereto by pre-weakened break points (13), and provided with a window (14).

Figure 4:
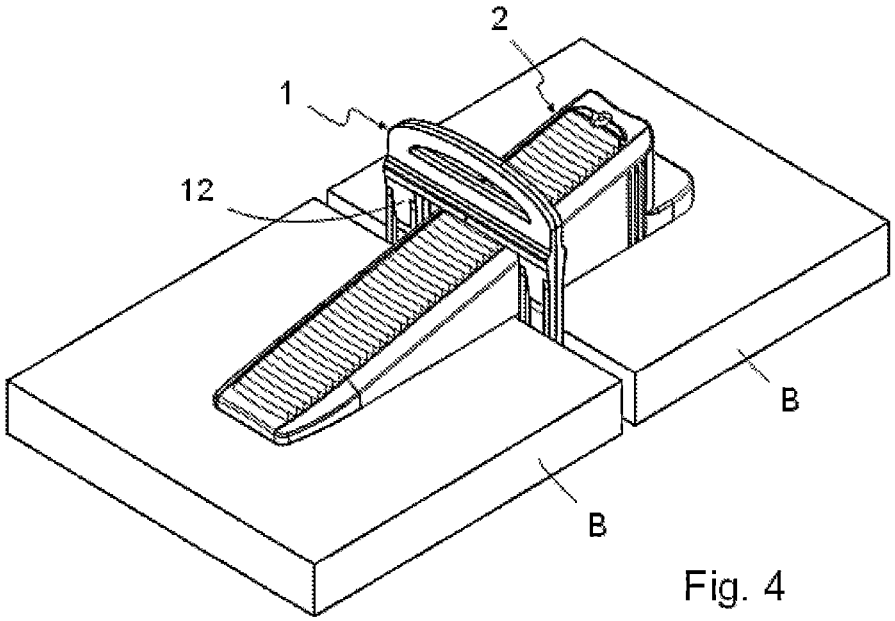
FIG. 4 shows a perspective view of the device of the invention, in a position of use, during the levelling and separating of two floor tiles.
Figure 5:
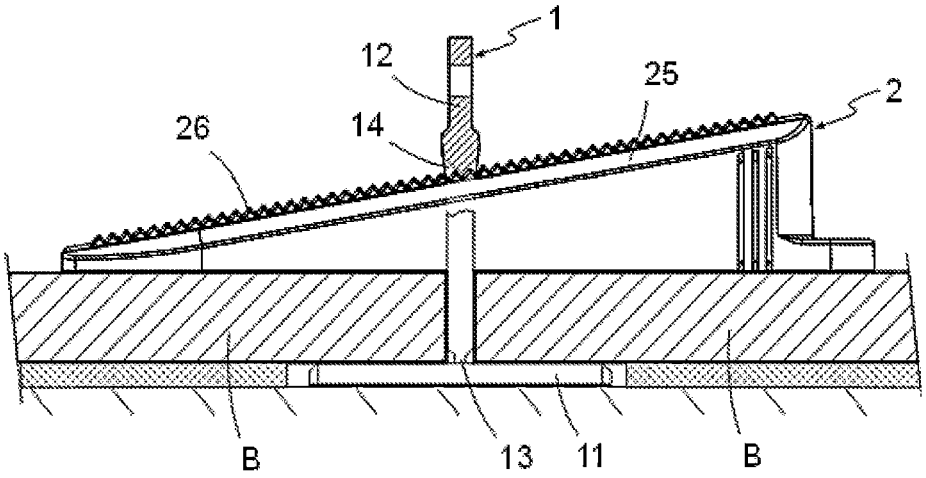
FIG. 5 corresponds to a profile view of FIG. 4, partially cross-sectioned.

The base (11) has on both sides of the separator element (12) two halves for supporting respective floor tiles (B) during the use of the device, as shown in FIGS. 4 and 5.

The levelling wedge (2), suited to be inserted into the window (14) of the separator element (12), comprises a lower surface (21) for support on the tiles (B) to be levelled, an upper surface (22) suited for acting in an upward direction against the upper end of the window (14) in the separator element (12); a rear surface (23), and lateral surfaces (24).

Figure 2:
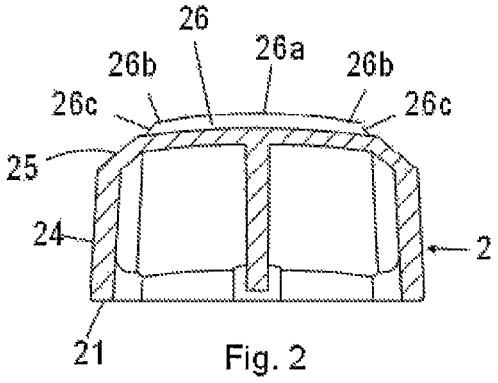
FIG. 2 shows an enlarged detail of a transversal section of the wedge, in which the curvature of the teeth in the transversal direction and the chamfered ends of the teeth can be seen.

As can be seen in the cross-sectioned detail of FIG. 2, the teeth (26) present superiorly, in the transversal direction, a curvature, defining therein a higher central area (26*a*) and laterally descending areas (26*b*).

The teeth (26) present chamfered lateral ends (26*c*), converging towards the upper area, which contribute to improve stress distribution and to prevent plasticisation of the material forming said teeth.

The wedge (2) presents on both sides of the upper surface (22) respective longitudinal recesses (25) laterally delimiting a central longitudinal portion in which the teeth (26) are defined and which is laterally separated from the vertical sides of the window (14) in the separator element during the use of the device.

Figure 3:
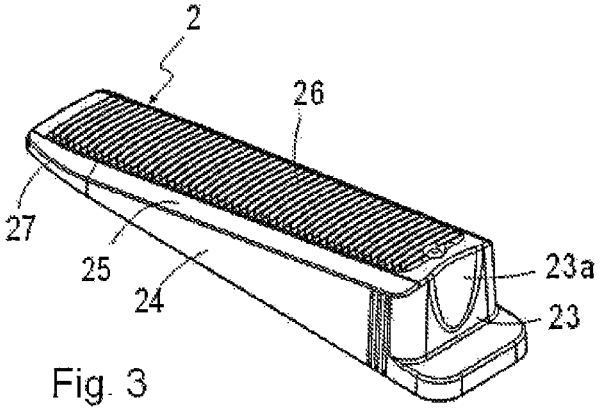
FIG. 3 shows a side-rear perspective view of the wedge.

As can be seen in FIG. 3, the wedge (2) presents on the rear surface (23) thereof a concave recess (23*a*), forming an ergonomic surface suited for manual thrusting of the wedge during the insertion thereof into the window (14) in the separator element (12) and the levelling of the floor tiles (B).

Figure 6:
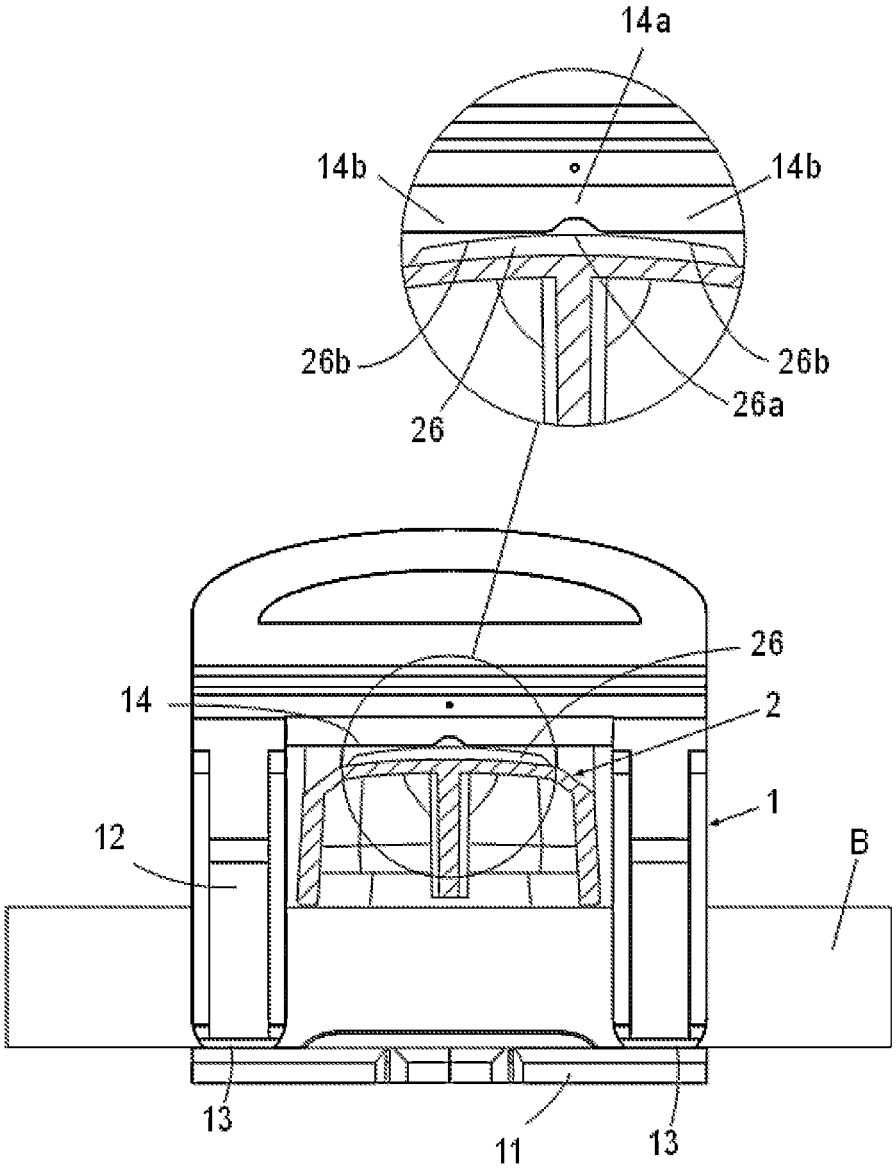
FIG. 6 shows a front view of FIG. 4 in which the wedge has been vertically cross sectioned through a transversal plane, and an enlarged detail of one of the teeth and the upper end of the window in the separator element.

In the position of use of the device, shown in FIGS. 4 to 6, two floor tiles (B) are placed on the respective halves of the base (11) of the body (1) so that they make contact with the facing ends thereof against the opposite faces of the separator element (12), which defines the separation between said floor tiles (B).

When the wedge (2) is inserted into the window (14) in the separator element to perform levelling and separating of two floor tiles (B), a force perpendicular to the separator element is produced which causes a deformation of the separator element; and the teeth (26) initially make contact with the central area (26*a*) with a central part (14*a*) of the window (14) in the separator element (12) and progressively with the laterally descending areas (26*b*) thereof with lateral parts (14*b*) that are more remote from the central part (14*a*) of the upper end of said window (14).

In this way, during the insertion of the wedge (2) into the window (14), the stress increases as the wedge makes contact with the lateral parts (14*b*) that are more remote from the centre. This makes the stress distribution between the contact of the separator element (12) and the wedge (2) much more uniform than in wedges with flat teeth; improving the performance of the assembly and increasing the life of the wedge (2) which is the reusable part of the device.

By inserting the wedge (2) into the portion of the window (14) protruding above the floor tiles (B), and pressing it in a frontal direction, the successive teeth (26) act progressively, initially with the protruding central area (26*a*) thereof and then with the lateral areas (26*b*) thereof against the upper end of the window (14), causing the levelling of the floor tiles (B).

Subsequently, once the tiles (B) have been levelled and conveniently fixed, an additional thrusting force is applied on the wedge until the separator element (12) breaks through the pre-weakened break points (13) and separates from the base (11) of the body (1).

It is worth mentioning that although the wedge (2) has been depicted inclined at one angle, it works equally well at the opposite angle.

Figure 7:
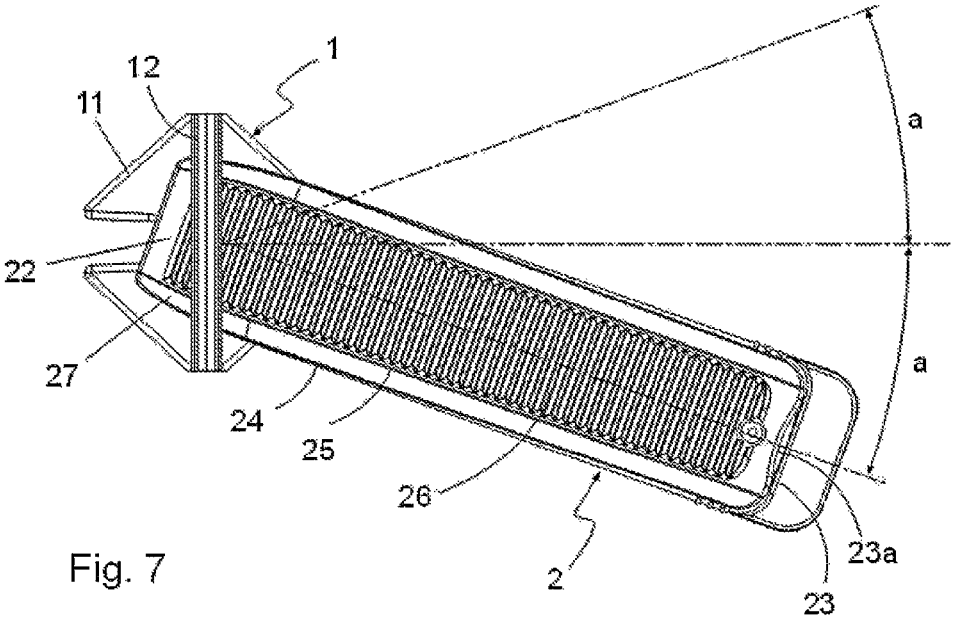
FIG. 7 shows an upper plan view of the wedge during insertion of the front end of the wedge at an oblique position into the window in the separator element; the maximum possible angles of insertion of the wedge with respect to the vertical median plane of the window being depicted.

The wedge (2) comprises in the front area thereof a segment (27) of decreasing width in lateral direction, which defines in said wedge (2) a front end of a width appreciably smaller than that of the window (14) in the separator element. As shown in FIG. 7 this front segment (27) of decreasing width towards the front end of the wedge, allows the insertion of the wedge (2) into the window (14) forming an angle (a) of about 30° towards one or the other side with respect to the vertical median plane of the window (14), making it unnecessary that the wedge (4) has to be positioned perpendicular to the window to perform said insertion.

Having sufficiently described the nature of the invention, in addition to a preferred exemplary embodiment, it is hereby stated for the relevant purposes that the materials, shape, size and layout of the described elements may be modified, provided that it does not imply altering the essential features of the invention claimed below.

The invention claimed is:

1. A device for levelling and separating floor tiles, comprising:

a body, with a "T" profile, provided with a supporting base for the tiles to be levelled and a separator element perpendicular to the supporting base, linked to said supporting base by pre-weakened break points, and the separator element being provided with a square window; and a levelling wedge configured to be inserted into the square window in the separator element and comprising: a lower surface for support on the tiles to be levelled; an upper surface for thrusting the separator element in an upward direction, provided with a plurality of transversal teeth;

a rear surface, and lateral surfaces;

wherein the teeth have an upper profile with a curvature, in a transversal direction, defining therein:

a higher central region, configured to provide a sector for initial contact of the teeth upper profile with a central part of a straight upper edge of the square window in the separator element during a frontal insertion of the levelling wedge into the square window in the separator element;

laterally descending sectors on both sides of this the higher central region configured for progressive contact with lateral parts that are more remote from the central part of the straight upper edge of said square window during a further insertion of the levelling wedge into the square window in the separator element; and chamfered lateral ends, converging towards an upper area of the levelling wedge and ending at the respective ends of said laterally descending sectors.

2. The device according to claim 1 wherein the levelling wedge comprises on both sides of the upper surface two longitudinal recesses delimiting on said upper surface a central longitudinal portion where the teeth are defined and laterally spaced from the lateral surfaces of the levelling wedge.

3. The device according to claim 1 wherein the levelling wedge comprises on the rear surface thereof a concave recess forming an ergonomic surface, configured for manual thrusting of the levelling wedge.

4. The device according to claim 1 wherein the levelling wedge comprises in a front area thereof a segment of decreasing width towards a front end of the levelling wedge; and that defines in said levelling wedge a front end of a width smaller than that of the square window.

* * * * *